US006010301A

United States Patent [19]

Oi et al.

[11] Patent Number: 6,010,301

[45] Date of Patent: Jan. 4, 2000

[54] FUEL PUMP FOR VEHICLE

[75] Inventors: Kiyotoshi Oi, Toyohashi; Masashi Miyamoto, Nishio, both of Japan

[73] Assignee: Denso Corporation, Japan

[21] Appl. No.: 08/961,089

[22] Filed: Oct. 30, 1997

[30] Foreign Application Priority Data

Nov. 8, 1996 [JP] Japan ..... 8-296209
Sep. 30, 1997 [JP] Japan ..... 9-265700

[51] Int. Cl.[7] ..... F01D 25/14

[52] U.S. Cl. ..... 415/55.2; 415/169.1

[58] Field of Search ..... 415/55.1, 55.2, 415/55.3, 55.4, 169.1; 123/516

[56] References Cited

U.S. PATENT DOCUMENTS 4,591,311 5/1986 Matsuda et al. .

5,192,184 3/1993 Nobuo et al. ..... 415/169.1

*Primary Examiner*—Edward K. Look
*Assistant Examiner*—Ninh Nguyen
*Attorney, Agent, or Firm*—Nixon & Vanderhye PC

[57] ABSTRACT

A fuel pump of returnless type fuel supply system for a vehicle includes a pump case, an impeller disposed in the pump case and a pump passage connected between the fuel inlet port and fuel discharge port. The pump passage is composed of a guiding passage section connected to the fuel inlet and pressure section connected between the guiding section and the fuel discharge port, and the guiding section has a first vapor discharge port disposed near the fuel inlet port and a second vapor discharge port disposed near the pressure passage section. Thus, fuel vapor is discharged from the first and second vapor discharge ports along with a small amount of the fuel returning to the fuel tank.

12 Claims, 4 Drawing Sheets

FIG. 6

| | 1ST D-PORT DIA./AREA | 2ND D-PORT DIA./AREA | RESULT |
|---|---|---|---|
| a) | ——— | 0.9mm/0.63mm² | NO GOOD |
| b) | 2mm/3.14mm² | ——— | ↑ |
| c) | 1.5mm/1.76mm² | ——— | ↑ |
| d) | 1.5mm/1.76mm² | 0.9mm/0.63mm² | ↑ |
| e) | 1.5mm/1.76mm² | 1.5mm/1.76mm² | GOOD |

FUEL PUMP FOR VEHICLE

CROSS REFERENCE TO RELATED APPLICATION

The present application is based on and claims priority from Japanese Patent Applications Hei 8-2960209 filed on Nov. 8, 1996, and Hei 9-265700, filed on Sep. 30, 1997, the contents of which are incorporated herein by reference.

BACKGROUND OF THE INVENTION

1. Field of the Invention

The present invention relates to a fuel pump which supplies fuel to an internal combustion engine of a vehicle from a fuel tank.

2. Description of the Related Art

In a returnless type fuel supply system for an internal combustion engine, excessive fuel and fuel vapor generated due to high temperature of the engine do not return to the fuel tank and, therefore, volatile components of the fuel remain in the fuel supply system. In a fuel pump having an impeller, fuel vapor is apt to be generated in the pump passage formed around the impeller. When the engine is idling, the amount of fuel injected by the pump is small because the fuel pump is controlled by an electronic control unit (hereinafter referred to as ECU), and the fuel vapor can not be discharged from the pump passage sufficiently. If the vapor remains in the pump passage, liquid fuel is cut into pieces by bubbles of the vapor and the pump passage can not be pressurized properly. As a result the fuel pump can not supply fuel to the engine properly (e.g., it is sometimes said to be "vapor locked").

In a fuel supply system having a fuel return passage as disclosed in JP-B-3-61038, a vapor discharging port is formed. However, such vapor discharging port can not be applied to the fuel pump used in the returnless type fuel supply system because most of the vapor remains around the fuel inlet port and does not move to the vapor discharging port.

SUMMARY OF THE INVENTION

A main object of the present invention is to provide a simple fuel pump for a returnless fuel supply system which discharges fuel vapor effectively therefrom.

According to a feature of the present invention, a fuel pump for a vehicle has an impeller, a pump passage connected between the fuel inlet port and a fuel discharge port. The pump passage comprises a guiding passage section connected to the fuel inlet and pressure passage section connected between the guiding section and the fuel discharge port, and the guiding section has a first vapor discharge port near the fuel inlet port and a second vapor discharge port near the pressure passage section.

Preferably, the first vapor discharge port is disposed at a downstream portion by an angle $\theta 1$ from the fuel inlet, and the second vapor discharge port is disposed at a downstream portion by an angle $\theta 2$ from the fuel inlet port, where the angles $\theta 1$ and $\theta 2$ have the following relationship:

$\theta 1<\theta 2<150°$, $\theta 1 \leqq 90°$.

Preferably, the second vapor discharge port has an area which is between 0.8 $mm^2$ and 4 $mm^2$, and the first vapor discharge port has an area which is between 0.7 $mm^2$ and 4 $mm^2$.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

FIG. 6 is a chart showing test results.

DETAILED DESCRIPTION OF THE PREFERRED EMBODIMENTS

Figure 3:
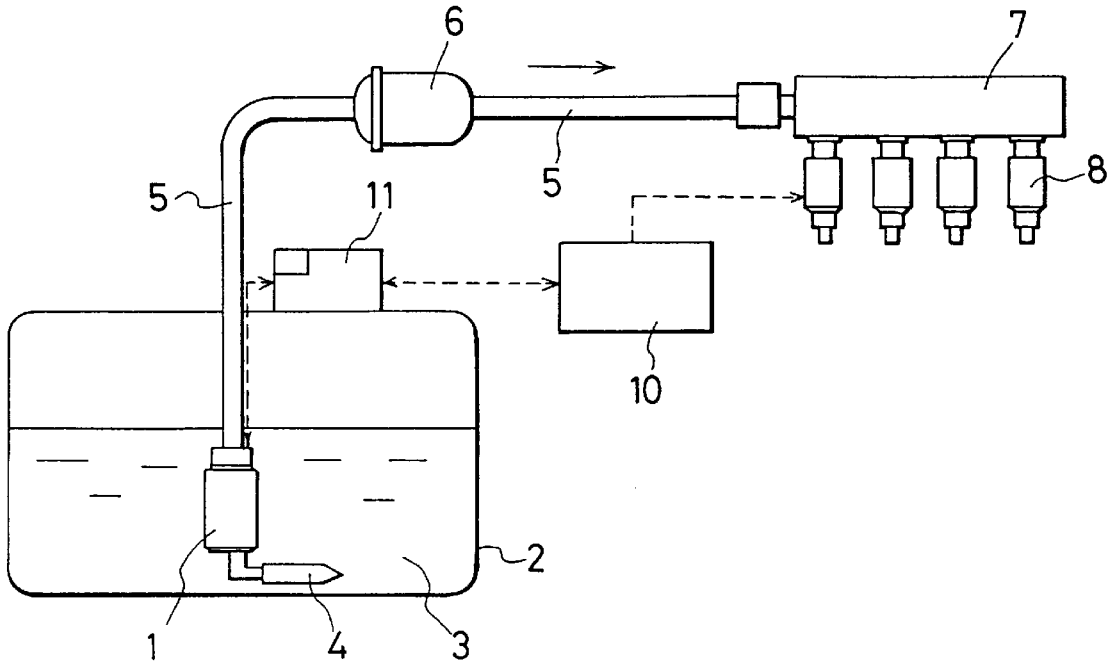
FIG. 3 is a schematic diagram illustrating a fuel supply system to which the fuel pump according to the present invention is applied.
Figure 4:
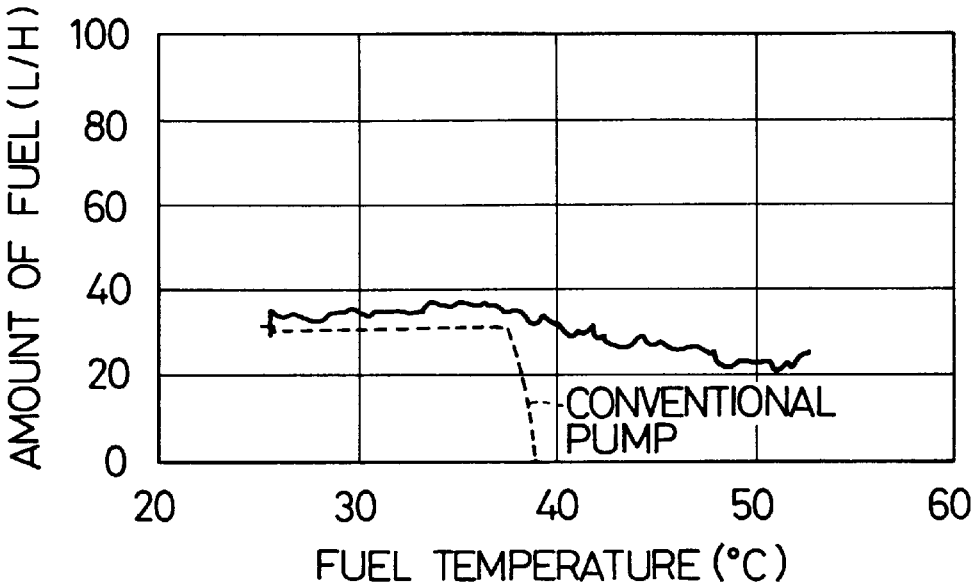
FIG. 4 is a graph showing relationship between fuel temperature and an amount of injected fuel.

In a returnless fuel supply system shown in FIG. 3, an intank-type fuel pump 1 is disposed in a fuel tank of a vehicle. The pump 1 pumps fuel 3 up through a net filter 4. The pumped fuel is supplied to a fuel rail 7 through a high pressure fuel filter 6 mounted in a fuel pipe 5. The fuel in the fuel rail 7 is pressured therein and injected into the cylinders of the engine by a plurality of fuel injectors 8.

Figure 1:
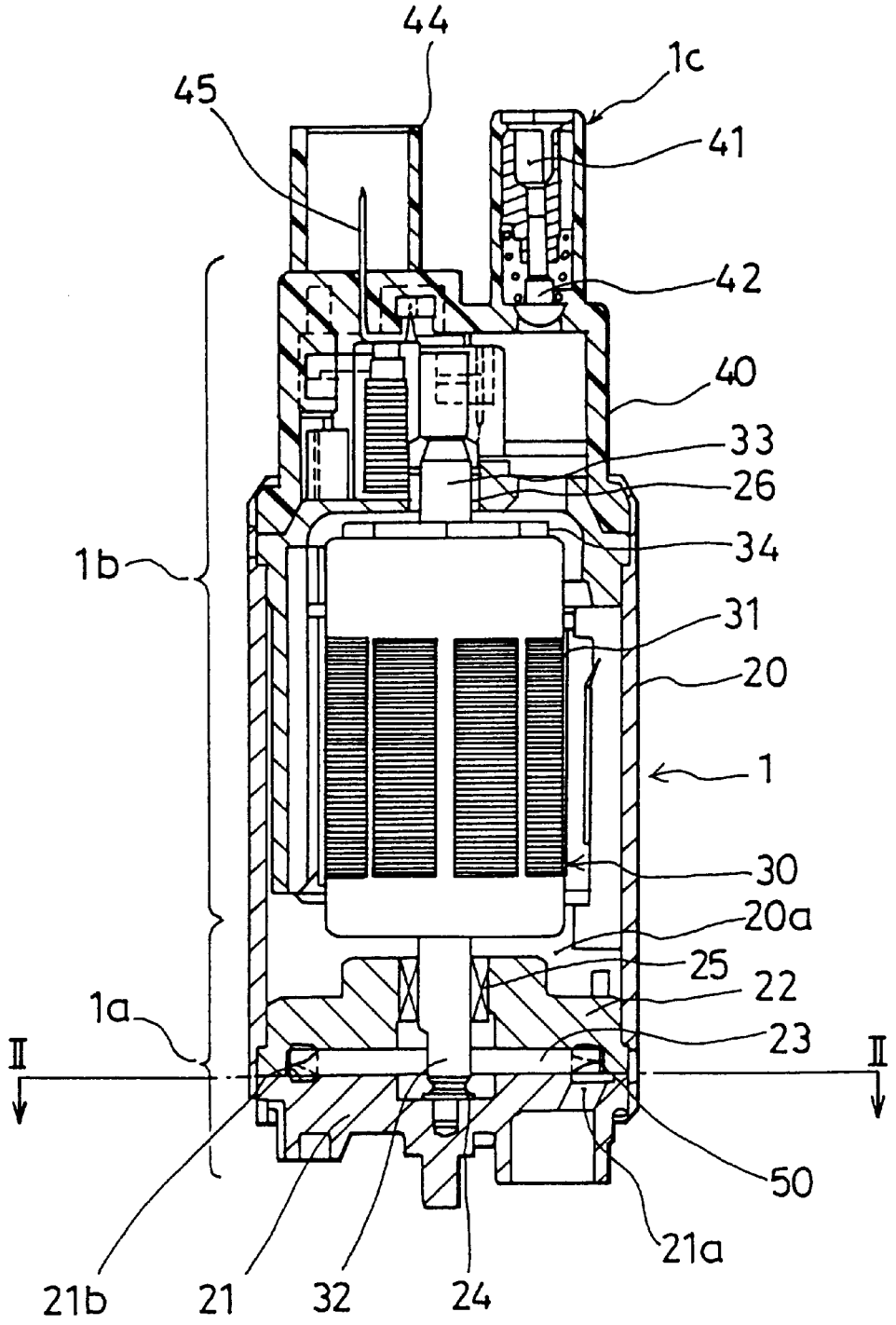
FIG. 1 is a cross sectional view illustrating a fuel pump according to an embodiment of the present invention.

ECU 10 decides the pressure of the fuel to be discharged from the fuel pump 1 according to conditions of the engine, etc., and sends a control signal to a fuel pump controller 11 (hereinafter referred to as FPC 11). FPC 11 converts the control signal to current so that the fuel pump is controlled according to the duty ratio of current supplied from an electric source (not shown). The discharge pressure of the fuel pump 1 is controlled by the control signal sent from the ECU 10 to FPC 11 so that the pressure in the fuel rail 7 is controlled to a predetermined value. The fuel pump 1 is composed of a pump section 1*a* which pumps up or sucks the fuel from the tank 2, a motor section 1*b* which drives the pump section la, a fuel outlet 1*c* which discharges the fuel pressured by the pump section 1*a* and a cylindrical housing 20, as shown in FIG. 1.

The pump section 1*a* has a pump cover 21, a pump casing 22, a C-shaped passage 50 formed therebetween and an impeller 23 disposed in the C-shaped passage 50. The pump cover 21 and the pump casing 22 are made of aluminum, and caulked to an end of the cylindrical housing 20. The pump cover 21 and the pump casing 22 can be made of phenol resin. A plurality of vane grooves are formed on the outer periphery of the impeller 23. When the impeller rotates, pressure differences are generated between adjacent vane grooves due to the fluid friction. The pressure differences are summed up over all the grooves to pressurized the fuel in the C-shaped passage 50. The fuel introduced into the C-shaped passage 50 from the fuel inlet port 21*a* formed in the pump cover 21 is pressured by the impeller 23, and sent to a motor chamber 20*a* of the motor section 1*b*.

Figure 2:
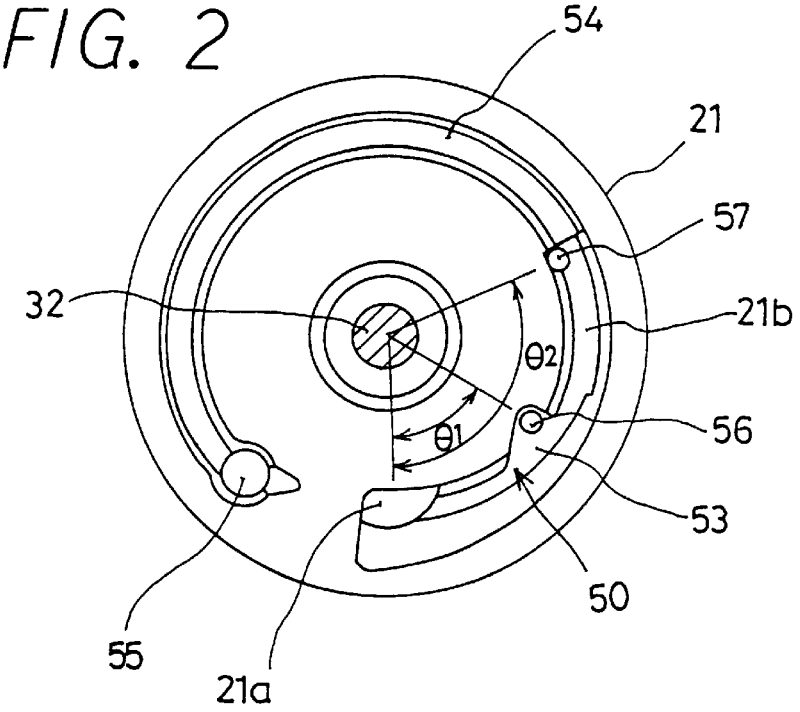
FIG. 2 is a cross-sectional view cut along a line II—II in FIG. 1.

A C-shaped groove 21*b* is formed on a surface of the pump cover 21 facing the pump casing 22, as shown in FIG. 2. The groove 21*b* forms a part of the C-shaped passage 50 and is composed of a guiding passage section 53 and a pressure passage section 54. The guiding passage section 53 is connected to the fuel inlet port 21*a* and has cross sections which become narrower (or shallower) gradually as they become more remote from the fuel inlet port 21*a*, and the pressure passage section 54 extends from the guiding passage section 53 to an C shaped passage discharge port 55 from which the fuel is supplied to the fuel outlet 1*c* through the motor chamber 20*a*.

Figure 5:
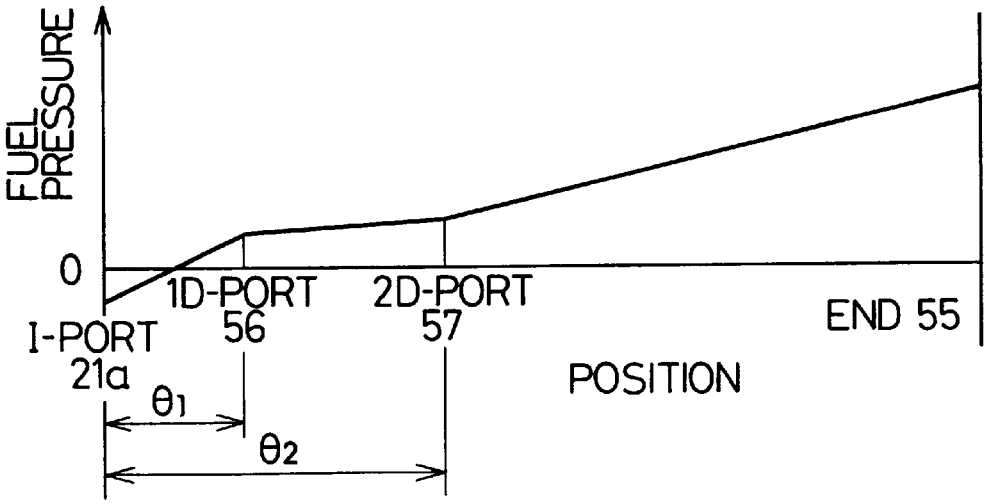
FIG. 5 is a graph showing relationship between position of vapor discharge ports and fuel pressure.

A first vapor discharge port 56 and a second vapor discharge port 57 are formed in the guiding passage section 53 to connect the C-shaped passage 50 with the fuel tank 2. The first vapor discharge port 56 has a diameter of 2 mm and is formed at a downstream portion which is close to the portion where the fuel pressure becomes nearly zero (zero pressure area), and the second vapor discharge port 57 has a diameter of 2 mm and is formed at an end of the guiding passage section 53, which is downstream of the first vapor discharge port 56, where the fuel pressure becomes positive (positive pressure area), as shown in FIG. 5.

The motor section 1*b* has a rotor 30 with a coil 31 and a commutator 34 and a stator with permanent magnets disposed at the circumference of the rotor 30. When the coil 31 is supplied with current through a connector pin 45 of a connector 44, the rotor 30 rotates. The rotor 30 has a shaft portion 32, which is supported by a thrust bearing 24 disposed in the pump cover 21, a ball bearing 25, and a shaft portion 33 supported by a metal bearing 26. The shaft 32 has a flat portion, to which the impeller 23 is fixed.

An outlet case 40 is caulked to the other end of the housing 20. The connector pin 45 is held in the connector 44 and is connected to the coil 31 through the commutator 34.

The fuel outlet lc has a check valve 42 disposed in a outlet port 41 formed in the outlet case 40.

The first and second discharge ports 56 and 57 are now described in more detail. Since the fuel pump 1 is controlled to discharge pressured fuel from the fuel outlet port 41 only as much as is necessary, the amount of the fuel flowing through the pressure passage section 54 is limited. However, an extra amount of the fuel is sucked from the fuel inlet port 21*a* into the guiding passage section 53 and discharged through the guiding passage section 53 from the first vapor discharge port 56 mainly and the second discharge port 57. When the impeller 23 rotates and sucks the fuel into the C-shaped passage 50, fuel vapor is generated. Most of the vapor is generated around the fuel inlet port 21*a* because the pressure around the inlet port 21*a* becomes negative. Since the extra amount of fuel forms an extra flow mainly between the fuel inlet 21*a* and the first vapor discharge port 56, the vapor moves along with the extra flow, and is discharged from the first vapor discharge port 56. The remaining vapor is discharged from the second vapor discharge port 57 above with another extra flow. Since the extra fuel flow is only necessary to carry the vapor, the amount of the extra fuel is very small and no significant power of the fuel pump 1 is necessary.

As shown in FIG. 5, the fuel pressure near the fuel inlet port 21*a* is negative and becomes more positive as the fuel moves to the C shaped passage discharge port 55 of the fuel pressure section 54. An angle θ1 between the fuel inlet port 21*a* and the first vapor discharge port 56 is equal to or smaller than 90°, preferably about 65°. An angle θ2 between the fuel inlet port 21*a* and the second vapor discharge port 57 is larger than θ1 and smaller than 150°, preferably about 120°. The second vapor discharge port 57 is formed in the guiding passage section 53 not to discharge excessive fuel therefrom (in other words, to prevent energy loss) and also prevent the vapor from entering into the pressure passage section 54. For this purpose, the pressure around the second vapor discharge port 57 is limited to a lowest pressure to discharge the vapor therefrom.

FIG. 6 shows test results of the fuel pump 1 having one or two fuel discharge port or ports with various diameters or areas. In the test, θ1 is set to 65°, and θ2 is set to 120°. Alcohol is used as the fuel and the initial amount of the fuel discharged by the pump is 30 liters/hour. The test is carried out under temperature increasing at a prescribed speed.

Test samples a), b) an c) have either one of the first and second vapor discharge ports, and the test results are not good. A test sample d) which has the first and second vapor discharge ports is not good because the size of the second vapor discharge port is too small. Samples e) is good because both the first and second vapor discharge ports have sufficient sizes.

According to the test results, the area S1 of the first vapor discharge port should be between 0.7 $mm^2$ and 4 $mm^2$, more preferably between 1.5 $mm^2$ and 2.5 $mm^2$, and the area S2 of the second vapor discharge ports should be between 0.8 $mm^2$ and 4 $mm^2$, more preferably between 1.5 $mm^2$ and 3 $mm^2$ When the impeller 23 is driven by the motor section 1*b* via the shaft 32, the fuel is sucked from the fuel tank 2 through the net filter 4 into the guiding passage section 53, where the vapor contained in the fuel is discharged from the first vapor discharge port 56 and the second vapor discharge port 57. Then, the fuel is pressurized in the pressure passage section 54 and discharged from the C shaped passage discharge port 55 into the motor chamber 20*a*. Subsequently, the fuel lifts the check valve 42 and flows out of the outlet port 41 to the fuel pipe 41. Thus, even if the fuel temperature rises above 37° C., at which the fuel is easy to be vaporized, the vapor can be eliminated from the pump passage.

The first and second vapor discharge ports 56 and 57 can be connected in the pump cover 21 so that the vapor can be sucked from the first vapor discharge port and carried by the fuel flowing out of the second vapor discharge port. Each of the first and second vapor discharge ports can be formed more than two.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive, sense.

What is claimed is:

1. A fuel pump including a pump case having a fuel inlet port and a fuel outlet port, an impeller disposed in said pump case and a pump passage connected between said fuel inlet port and fuel outlet port, wherein:

said pump passage comprises a guiding passage section connected to said fuel inlet port and a pressure passage section disposed between said guiding passage section and said fuel outlet port, said guiding passage section comprising a main fuel flow portion through which fuel flows from said fuel inlet port to said pressure passage section;

said guiding passage section has a first vapor discharge port disposed near said fuel inlet port and a second vapor discharge port disposed downstream of said first vapor discharge port, at the end of said guiding passage section connected to said pressure passage section, said first and second vapor discharge points beings in direct communication with said main fuel flow portion of said guiding, passage section;

said guiding passage section guiding fuel at a first lower pressure to discharge a portion of the fuel therein and vapor mainly from said first vapor discharge port and additionally from said second vapor discharge port, whereby the remaining fuel can be properly pressurized in said pump passage; and said pressure passage section pressurizing said fuel to a fuel supply pressure higher than said first lower pressure.

2. A fuel pump as in claim 1, wherein:

said first vapor discharge port is disposed at a downstream portion by an angle θ1 from said fuel inlet port;

said second vapor discharge port is disposed at a downstream portion by an angle θ2 from said fuel inlet port; and said angles θ1 and θ2 have the following relationship: $\theta 1<\theta 2<150°$, $\theta 1 \leqq 90°$.

3. A fuel pump as in claim 2, wherein said second vapor discharge port has an area which is between 0.8 $mm^2$ and 4 $mm^2$.

4. A fuel pump as in claim 3, wherein said first vapor discharge port has an area which is between 0.7 $mm^2$ and 4 $mm^2$.

5. A fuel pump as in claim 1, wherein:

said guiding passage has a cross section gradually narrowing as it becomes more remotely situated from said inlet port.

6. A fuel pump as in claim 1, wherein:

said first vapor discharge port is located at a portion of said guiding passage where fuel pressure becomes nearly zero.

7. A fluid fuel pump comprising:

an arcuate pump passage wherein fluid is caused to flow by moving impeller vanes from a fluid inlet at one end of the pump passage to a fluid outlet at an opposite end of the pump passage;

said pump passage including an initial guiding passage portion upstream of a smaller diameter pressure passage portion, said initial guiding passage portion comprising a main fluid flow portion through which fluid flows from said fluid inlet to said pressure passage portion;

a first vapor discharge port disposed in said main fluid flow portion of said guiding passage at a first location to discharge vapor entrained with fluid out of said pump passage; and a second vapor discharge port also disposed in said main fluid flow portion of said guiding passage at a second location downstream of said first location at the end of said guiding passage connected to said pressure passage, said second vapor discharge port also discharging vapor entrained with fluid out of said pump passage, whereby fluid fuel can be properly pressurized in said pump passage.

8. A fluid fuel pump as in claim 7 wherein:

said first vapor discharge port is disposed at a downstream portion by an angle θ1 from said fuel inlet port;

said second vapor discharge port is disposed at a downstream portion by an angle θ2 from said fuel inlet port; and said angles θ1 and θ2 have the following relationship: $\theta 1<\theta 2<150°$, $\theta 1 \leqq 90°$.

9. A fluid fuel pump as in claim 8 wherein said second vapor discharge port has an area which is between 0.8 $mm^2$ and 4 $mm^2$.

10. A fluid fuel pump as in claim 9 wherein said first vapor discharge port has an area which is between 0.7 $mm^2$ and 4 $mm^2$.

11. A fluid fuel pump as in claim 7 wherein:

said guiding passage has a cross section gradually narrowing as it becomes more remotely situated from said inlet port.

12. A fluid fuel pump as in claim 7 wherein:

said first vapor discharge port is located at a portion of said guiding passage where fuel pressure becomes nearly zero.

* * * * *